US006730166B2

(12) United States Patent
Kiener et al.

(10) Patent No.: US 6,730,166 B2
(45) Date of Patent: May 4, 2004

(54) DEVICE FOR THE APPLICATION OF FLUID MATERIALS TO A SURFACE OF A STRIP MATERIAL

(75) Inventors: Waldemar Kiener, Lauchheim (DE); Johann Rein, Bopfingen (DE)

(73) Assignee: Bundesdruckerei GmbH, Berlin (DE)

( * ) Notice: Subject to any disclaimer, the term of this patent is extended or adjusted under 35 U.S.C. 154(b) by 0 days.

(21) Appl. No.: 10/221,434

(22) PCT Filed: Feb. 28, 2001

(86) PCT No.: PCT/EP01/02245

§ 371 (c)(1),
(2), (4) Date: Dec. 26, 2002

(87) PCT Pub. No.: WO01/76767

PCT Pub. Date: Oct. 18, 2001

(65) Prior Publication Data

US 2003/0089309 A1 May 15, 2003

(30) Foreign Application Priority Data

Mar. 10, 2000 (DE) ..... 100 11 769

(51) Int. Cl.[7] ..... B05C 1/08

(52) U.S. Cl. ..... 118/262; 118/249; 118/DIG. 14; 118/DIG. 15; 118/262; 156/578

(58) Field of Search ..... 118/249, 262, 118/DIG. 14, DIG. 15; 156/233, 235, 249, 578; 101/216; 492/60; 427/428

(56) References Cited

U.S. PATENT DOCUMENTS

| | | | | | |
|---|---|---|---|---|---|
| 3,572,855 A | * | 3/1971 | Weichsel | ..... | 384/132 |
| 4,214,708 A | * | 7/1980 | Lacchia | ..... | 239/703 |
| 4,924,802 A | | 5/1990 | Knop | ..... | 118/410 |

* cited by examiner

*Primary Examiner*—Laura Edwards

(57) ABSTRACT

The invention relates to a device for the application of fluid materials to a surface of a sheet-form material, comprising an application roller, with a roller body and a jacket surface, which, by means of at least partial contact with the sheet-form material, transfers the fluid materials leading to the sheet-form material. The invention further comprises an application doctor blade, with a pre-dosing channel for the supply of fluid materials leading thereto and which at least partly coats the application roller with fluid material. A flow of a medium is provided in at least one region adjacent to the jacket surface, which is directed from the longitudinal mid-axis of the application roller to the outside.

21 Claims, 6 Drawing Sheets

DEVICE FOR THE APPLICATION OF FLUID MATERIALS TO A SURFACE OF A STRIP MATERIAL

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a device for the application of fluid materials to a surface of a sheet-form material, with an application roller which has a roller body with an outer surface which when at least partially abutting on the sheet-form material transfers the fluid material to the sheet-form material.

TECHNICAL FIELD

Numerous apparatuses are already known for the application of fluid materials to a surface of a sheet-form material. Each of these apparatuses requires a special adaptation to the respective materials to be applied and to the circumstances as regards the properties of the sheet-form material, processing temperature, speed and the amount of the material to be applied and also the kind of the material to be applied.

In laminating at least two sheet-form materials it is necessary that a defined amount of fluid materials, particularly adhesive, is applied to at least a first layer of the sheet-form material, so that this layer is applied to at least a further layer of a sheet-form material and remains on this at least one layer of the sheet-form material due to a resulting adhesive bond. The sheet-form material can be, for example, very thin polymer foils or carrier layers, which are extremely sensitive to tensions. Furthermore, a further layer can be laminated, for example, onto a layer with visual information. For this, it is necessary that a uniform bonding between the layers is made possible, so that the information can be recognized and examined.

The use of fluid materials, particularly adhesives, which are taken up by an application roller from a supply region and transferred to the sheet-form material, is necessary for the lamination of layers. In this process of applying the fluid material to the sheet-form material, particularly in the case of adhesives, a soiling of the application roller and its bearing regions occurs. The functional ability or the rotation of the application roller can thereby be worsened or even stopped, which can result in an uneven application of the fluid material to the sheet-form material, or an application of the fluid material to the sheet-form material is rendered impossible.

SUMMARY OF THE INVENTION

The invention therefore has as its object to provide an apparatus for the application of fluid materials to the surface of a sheet-form material, which makes possible a uniform application of a set thickness of a film during a very long duration of operation.

This object is attained with a metering doctor to which a pre-metering channel leads for provision of the fluid material and at least partially wets the application roller with fluid material. A flow of a medium directed substantially outward from a longitudinal mid-axis of the application roller is provided at least in a region bordering on the outer surface of the application roller.

By the use of a medium which at least partially flows radially outward in the edge region of the roller body of the application roller, it is made possible that the fluid material, seen in the axial direction, does not leave the outside surface of the roller body at least in the direction of the bearing regions of the application roller, so that a penetration of the fluid material to the bearing regions of the application roller is prevented. By the bounding of the outside surface by means of a fluid medium, a defined application width of the fluid material on the surface of the sheet-form material can be given, which can be adjusted to the requirements for the further processing of the sheet-form material onto a further layer of a sheet-form material, particularly when the sheet-form material is wider than the outside surface of the application roller.

The air flowing out in the edge region of the roller body of the application roller forms a seal of the bearing region, which furthermore makes it possible for the application roller to be used both for a so-called flying coating, in which the application roller works solely against a sheet tension of the sheet-form material, and also for a coating with the use of a counterpressure roller.

According to an advantageous embodiment of the invention, it is provided that at least one axial bore is provided at least at one end of the application roller, and cross bores branch off therefrom, preferably in the edge region of the outside surface. The medium, preferably under pressure, can thereby be supplied in a simple manner to the edge region of the outside surface, so that a lateral sealing of the application roller relative to the respective bearing is made possible.

According to a further advantageous embodiment of the invention, it is provided that a receiving member is provided at each end of the roller body and forms with the edge region of the roller body a gap leading outward. Sealing of the bearing regions and limitation of the outside surface of the roller body as application surface is thus made possible. It is advantageously provided that the receiving member at least partially covers the cross bore. A guide channel or gap for the medium can thus be formed by a receiving member in a simple manner, and is constituted as far as the outside surface of the roller body.

According to a further advantageous embodiment of the invention, it is provided that the receiving member is constituted as a bearing and has a bearing section for receiving the application roller. Thereby on the one hand, the number of components is reduced, and also, on the other hand, simple and rapid mounting is made possible.

According to a further advantageous embodiment of the invention, it is provided that the end face of the roller body and the surface of the receiving member arranged complementary thereto form a gap which is directed at right angles to the longitudinal axis of the application roller or at an angle in the direction of the edge region of the sheet-form material or of the bearing regions. A fluid material possibly overflowing over the edge region of the outside surface of the roller body can thereby be guided away laterally outward, without the set coating thickness of the fluid material on the sheet-form material being adversely affected.

According to a further advantageous embodiment of the invention, it is provided that the gap between the end face of the roller body and the receiving member is adjustable. The sealing can thereby take into account the respective case of application and the sensitivities of the fluid material and of the sheet-form materials. The flow speed of the medium which flows outward through the gap can advantageously be likewise adjustable.

According to a further advantageous embodiment of the invention, it is provided that a UV crosslinking-active adhesive is provided. In particular, this embodiment is of particular advantage with these adhesives which immediately harden or polymerize when subjected to shear.

According to a further advantageous embodiment of the invention, it is provided that compressed air us used as the medium. A cost-favorable embodiment can thereby be given, since the surrounding air can be compressed and used. It can alternatively be provided that special gases or liquid media or the like are used in order to effect a sealing of the bearing regions.

According to a further advantageous embodiment of the invention, it is provided that the application roller is received by adjustable bearings. It is thereby made possible for the amount of the fluid material taken up from a metering region of the application roller to be adjustable. The bearings can also serve as an additional possibility of adjustment to the metering doctor. Furthermore, changes due to the use of the application roller and possibly of the bearings can be adjusted for.

According to a further advantageous embodiment of the invention, it is provided that the rotation speed of the application roller is equal to or smaller than the sheet speed of the sheet-form material. Thereby a more uniform and thinner film of a fluid material can be applied. In this mode of operation, it can advantageously be provided that the sheet-form material abuts the application roller under tension, which can be adjusted by means of a guide roller before and after the application roller in the sheet forwarding direction.

BRIEF DESCRIPTION OF THE DRAWINGS

A particularly preferred embodiment of the invention is shown in the following description and the accompanying drawings, in which.

DETAILED DESCRIPTION OF THE INVENTION

Figure 1:
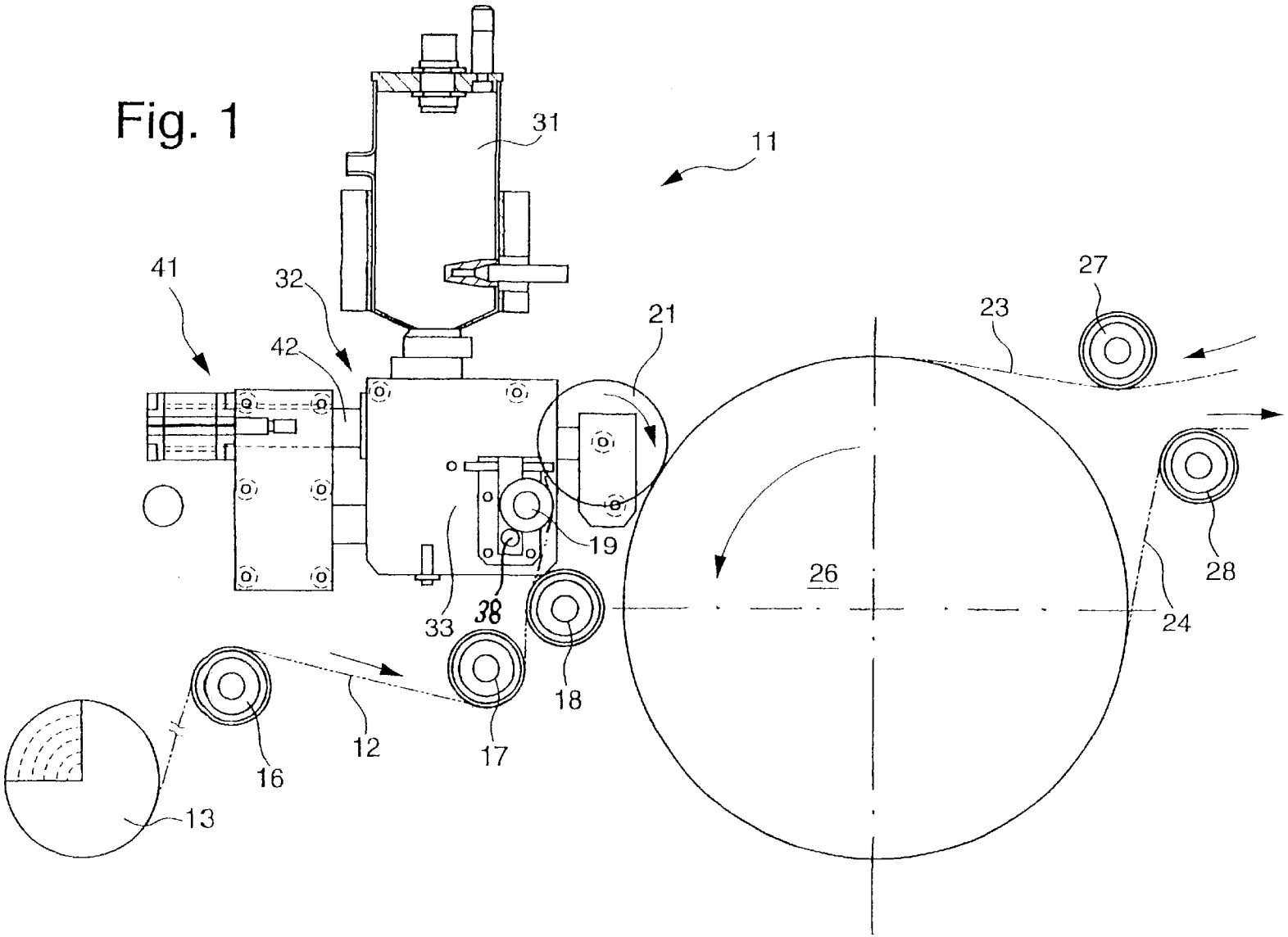
FIG. 1 shows a schematic side view of the apparatus according to the invention.

A side view of an apparatus 11 for the application of a fluid material to a surface of a sheet-form material 12 is shown in FIG. 1. The material 12 is drawn from a supply roll 13 and guided over guide rollers 16, 17, 18 to an application roller 19 for applying the fluid material to the sheet-form material 12.

The sheet-form material 12 coated with fluid material is deflected by means of a transport roller 21 and supplied to a foil or a film 23, in order to form a composite 24. The foil 23 is forwarded by a roller 26 to the apparatus 11, guide rollers 27, 28 being provided before and after the apparatus 11 and causing the foil 23 to wrap around the roller 26.

FIG. 1 shows, for example, a processing station in a plant consisting of plural stations. The operational process described hereinafter, in which the apparatus 11 undertakes an operational step, represents a case of application for this embodiment example.

For the production of documents which are secure against forgery, a photopolymer film with holograms is for example used. These photopolymer foils are delivered with protective layers on both sides. For further processing into a document which is secure against forgery, it is necessary for the protective layers to be removed and for subsequent carrier layers to be applied. In a first operation cycle, a delaminating apparatus (not shown) which removes the protective layer can be provided, for example on the roller 26. A carrier layer is then applied as a sheet-form material 12 to the photopolymer foil by the apparatus 11 according to the invention. A hardening device is provided following the apparatus 11 and produces a composite 24 between the applied carrier layer and the photopolymer foil, a UV crosslinking-active adhesive being provided, preferably as a fluid material. In a second operating cycle, which follows the first operation cycle just described, the process can be repeated for the second side. Because of the high processing speeds and quality requirements, it is necessary that the carrier layer has a fluid material applied to one surface, uniformly and with constant film thickness, so that in the further processing a bubble-free and continuously crosslinked composite due to the adhesive results between the applied carrier layer and the photopolymer film.

The apparatus 11 for applying fluid materials to the surface of a sheet-form material 12 can be used for further cases of application which are similar to, or deviate from, the case of application described hereinabove. Here foils a few micrometers thin, or also thick foils, of plastic or other materials, can be likewise treated and processed.

A fluid material is stored in a dispenser 31. When a UV crosslinking-active adhesive is processed, a light-protected dispenser 31 is preferably used. The fluid material is supplied from this dispenser 31 by static pressure by means of a housing section 32 to a pre-metering channel 33 of an application head 34. This is shown in detail in a partial sectional view of the apparatus 11 according to FIG. 2. The fluid material is supplied via the pre-metering channel 33 to a metering doctor 36, which is preferably constituted as a metering bar. This metering doctor 36 is adjustable by means of a setting mechanism 37 so that the transverse profile is thereby adjustable along the metering doctor 36. The metering doctor 36 is furthermore rotatably mounted. In a position of a break-off edge facing toward the application roller 19 as shown in the drawing, the gap is zero. The size of the gap can be adjusted with an anticlockwise rotation of the metering doctor 36, the gap size increasing with an increasing degree of rotation. The amount of the fluid material to be taken up by the application roller 19 can thereby be determined. The metering doctor 36 is provided with metering pockets 40 extending at least over the length of the outside surface 59 of the roller body 58. The metering pockets could be provided in they form of a recess. The application roller 19 is provided in an upper section of the application head 34, a segment region 38 being arranged outside the application head 34. The sheet-form material 12, which is constituted as a carrier layer according to the embodiment example described above, is guided past this segment region 38 which stands out with respect to the application head 34. The guide roller 18 and the transport roller 2I are positioned with respect to the application roller 19 so that the sheet-form material 12 abuts the application roller 19 with at least slight tension. The transport roller 2I can be adjusted in its position with respect to the application roller 19 by means of an adjusting mechanism 39 shown in detail in FIG. 6. The arrangement with respect to the roller 26, also respectively the distance or pressure, can likewise be adjusted by means of this adjusting mechanism 39.

The apparatus 11 can be mounted on a housing of the equipment by means of the elements identified with the reference numeral 41. The housing section 32 and also the application roller 19 and transport roller 21 connected to it can be moved away from the roller 26 in a simple and rapid manner by means of two shafts 42 (FIG. 2) projecting into the housing section 32, in order to clean or newly insert the parts, or to feed in new sheet-form material.

Figure 2:
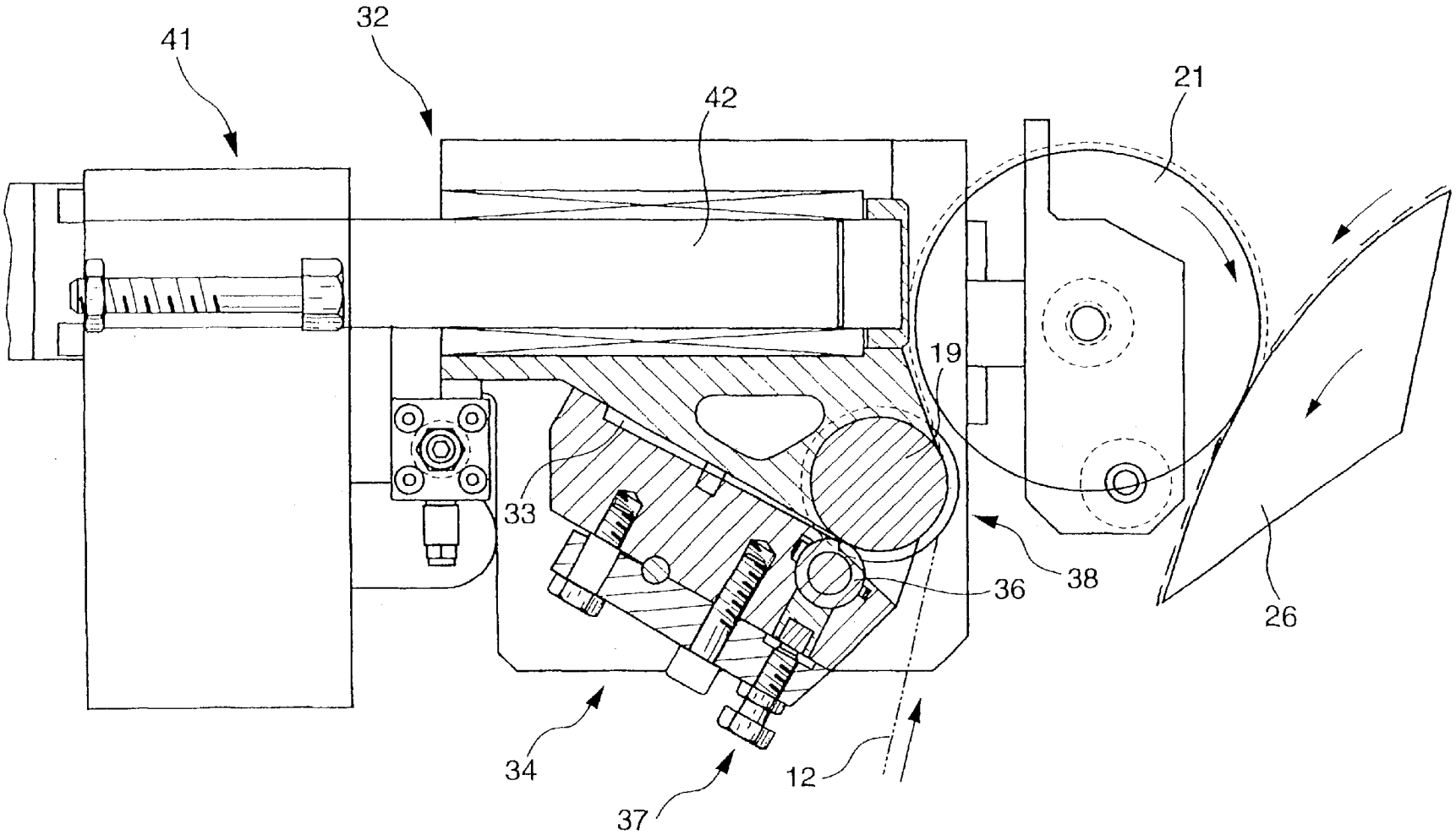
FIG. 2 shows a schematic enlarged partial view, partially in cross section, of the apparatus according to the invention according to FIG. 1.
Figure 3:
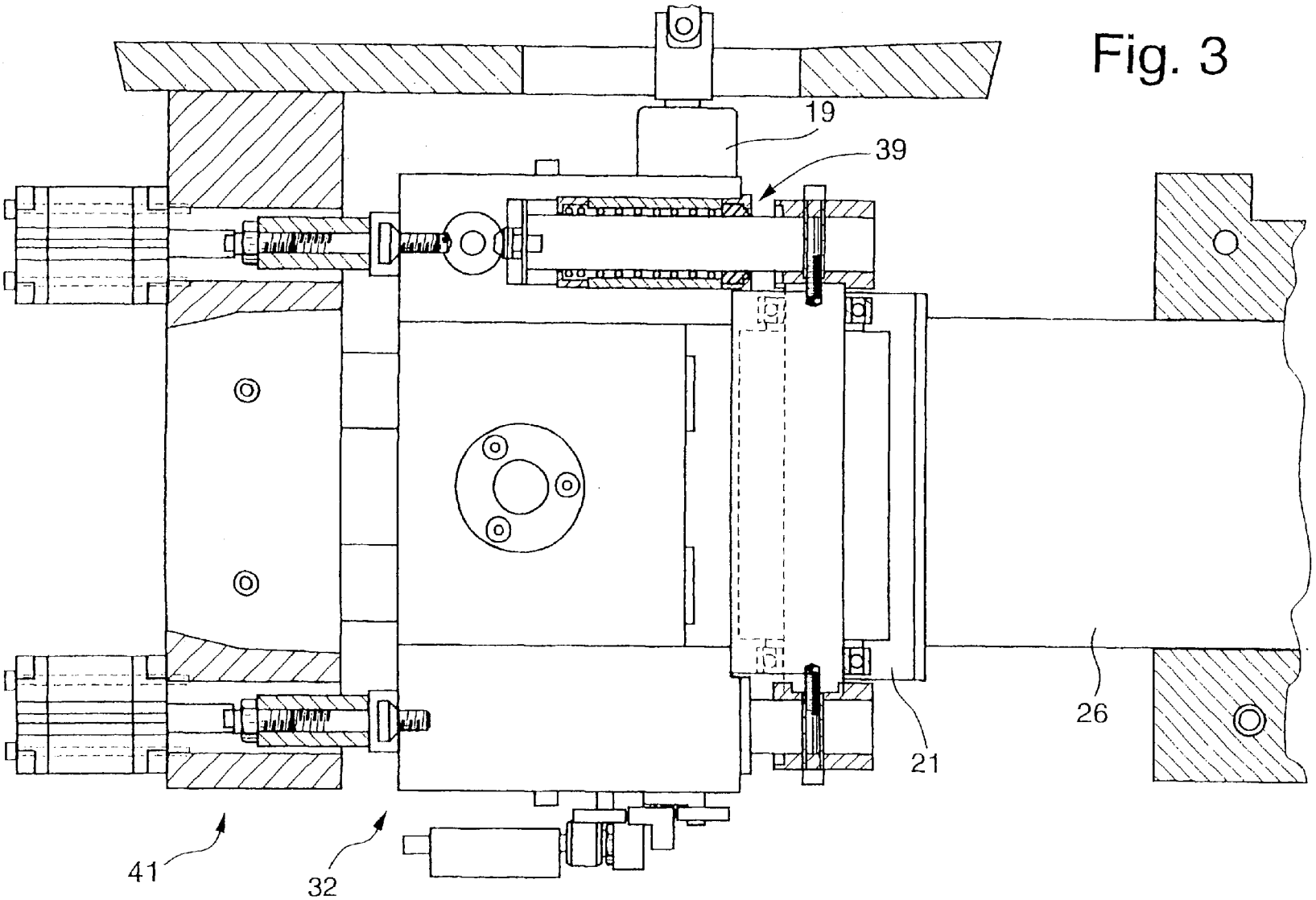
FIG. 3 shows a schematic enlarged sectional diagram of a top plan view according to FIG. 2.

A schematic top plan view according to FIG. 2 is shown in partial cross section in FIG. 3. The roller 21 is constituted wider than the roller 26 for the application case described by way of example. The relationships with respect to the width of the rollers 21 and 26 and also their diameter can be selected specifically for an application. This likewise holds for the relationships of the application roller 19 and of the metering doctor 36.

Figure 4:
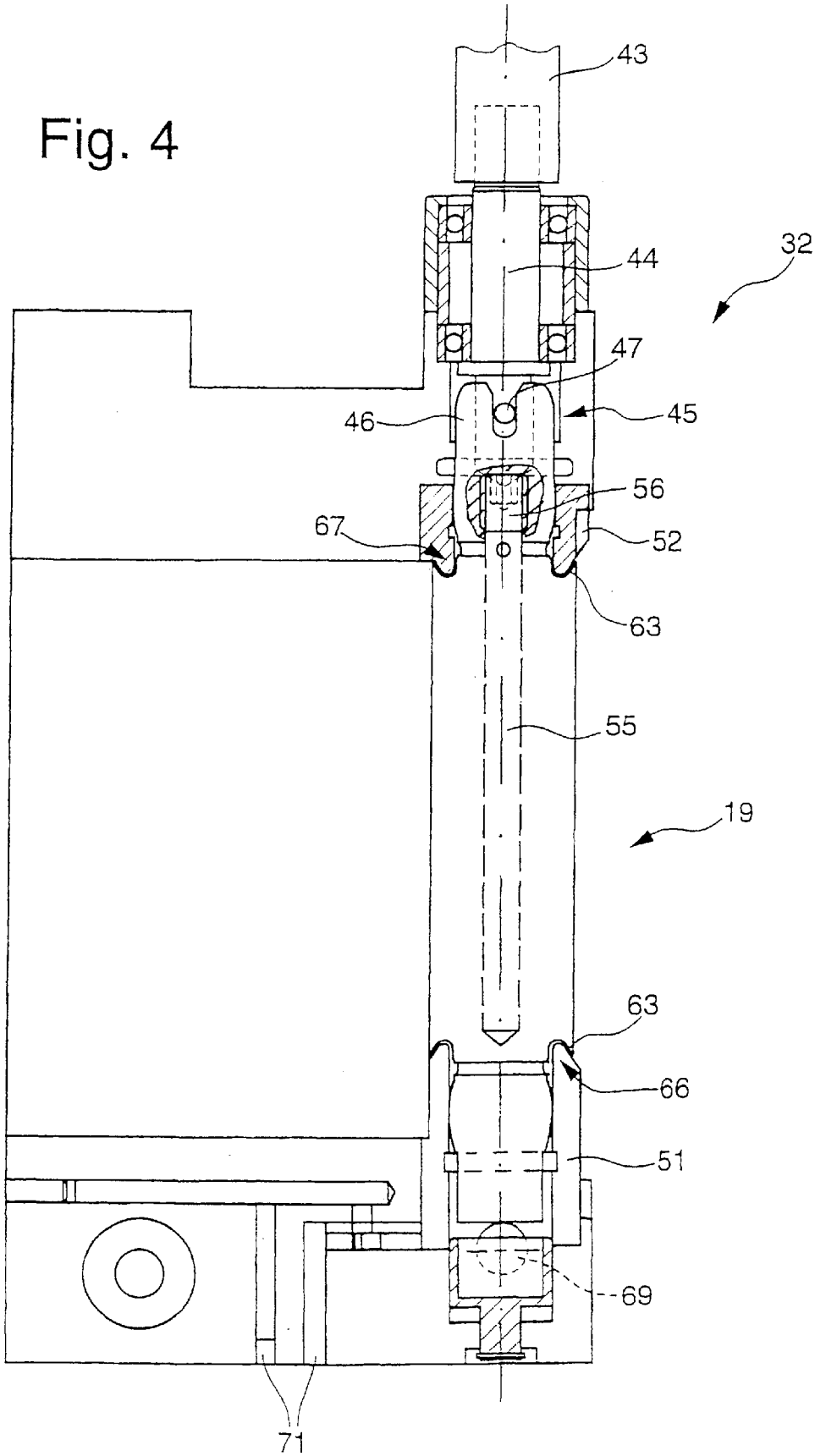
FIG. 4 shows a schematic detail diagram of an application roller and its bearing arrangement.

The application roller 19 is shown in detail in FIG. 4. This application roller 19 is rotatably driven. For example, a drive shaft 43 is provided which engages a coupling 44 which is constituted as a roller-mounted shaft. A spigot connection 45 is provided on the end remote from the drive shaft 43, and transmits the rotation of the drive shaft 43 to the application roller 19. For this purpose, a U-shaped recess is provided on a connecting piece 46 of the application roller 19, with a bolt 47 engaging in it and equalizing axial tolerances between the coupling 44 and the application roller 19.

Figure 5:
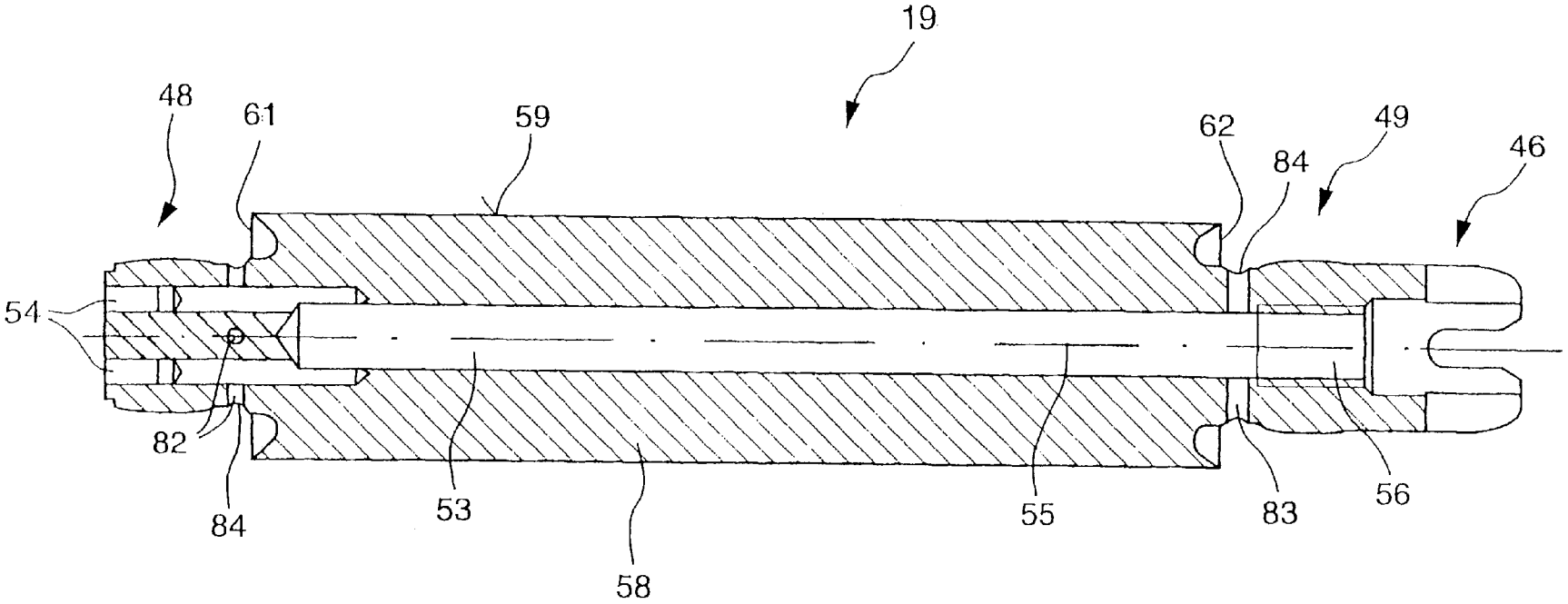
FIG. 5 shows a detail view of the application roller in cross section.

The application roller 19, shown in complete cross section in FIG. 5, has a left-hand and a right-hand bearing region 48, 49. These shaft sections are of crowned form and are rotatably mounted in a receiving member 51, 52 which can be installed on the housing section 32. The crowned form can provide an axial compensation between the left and right receiving members. Even with a small displacement of the mutually opposite receiving bores of the holding elements, a smooth-running rotation of the roller without jamming can be given. The application roller 19 is constituted as a hollow shaft and has a through bore 53 situated in the longitudinal mid-axis 55 and connected on one side to two axial bores 54. In the region of the bearing region 49, the through bore 53 is closed, sealed to medium, by a threaded pin 56 or the like. The application roller 19 has a roller body 58 with an outside surface 59 by means of which the fluid material is transferred to a surface of the sheet-form material 12. End faces 61, 62 are provided in the transition region between the bearing regions 48, 49 and the roller body 58, and form with the receiving members 51, 52 a gap 63. Complementary sections 66, 67 of the receiving member 51, 52 are provided in the region of the end faces 61, 62, and extend over the whole periphery.

In the housing section 32, a counter-bearing 69 is provided at the end of the application roller 19 opposite the drive shaft 43, making a supply of the medium possible via connections 71 into the axial bores 54. The medium, preferably under pressure, reaches the through bore 53 via the axial bores, and from there passes outward via cross bores 82, 83 branching therefrom. The medium is deflected by the receiving member 51, 52 covering the openings 84 of the cross bores 82, 83, and is conducted outward by means of the gap 63. A leakproof or nearly sealing connection is produced by the bearing regions 48, 49 and the receiving members 51, 52, so that medium emerging from the cross bores 82, 83 is positively guided outward by the gap 63.

In a preferred embodiment of the invention, it is provided that air is used as the medium, and is preferably conducted outward under pressure through the gap 63. Likewise, gaseous, liquid, or gel-form media or the like can be used, depending on the case of application.

Sealing-off of the bearing regions 48, 49 can be attained by blowing air in, the air flowing at least partially radially outward through the gap 63. This is particularly advantageous with the use of UV crosslinking-active adhesives, which would harden in a short time when exposed to shear stress, as is the case when the adhesive enters the bearing regions 48, 49. Stoppage of the application roller or impairment of its operation can thus be counteracted.

The gap 63 is arranged at an angle due to the side surfaces 61, 62 and the complementary sections 66, 67 of the receiving members 51, 52, so that the direction of blowing out faces outward with respect to the outer surface 59. The fluid material coming out over the edge region of the outer surface 59 can thereby be blown off, so that this does not accumulate in the region of the gap 63.

The design of the gap 63, as regards width and also direction, can take place optionally; the alignment in FIG. 4 is solely by way of example. The gap 63 can be constituted constant or nozzle-shaped toward the outer surface 59, so that a kind of venturi effect can arise in the outermost edge region between the outer surface 59 of the roller body 58 and the sections 66 and 67 of the receiving members 51, 52. It can furthermore be provided that instead of a complete, radial outflow of the medium, an at least partial and/or swirled outflow is provided. It can furthermore be provided that the constitution of the gap 63 is provided by inserts which can be installed on the end faces 61, 62 and communicate with the receiving portions 51, 52. It can likewise be provided that the receiving members 51, 52 have interfaces to receive inserts, which are interchangeable. The size, the kind, and also the length of the gap can be selectively varied and adapted specifically to the application in dependence on the case of application. This can be made possible, for example, by ring segments which can be fixed on and interchanged. The application roller 19 furthermore has an adjustable mounting, which makes it possible for both an adjustment as regards the axial spacing from the metering doctor 36 and also an axially parallel adjustment.

The application roller 19 is made of a material which is resistant to the fluid material. For example, stainless steel or bronze or the like can be provided. The structure or surface of the outer surface 59 can be implemented specifically for the application. The use of compressed air for sealing the gap 63 between the outer surface 59 of the application roller 19 and a receiving member 51, 52 adjoining thereto can for example begin at 0.1 bar and rise to one or more bar.

In the case described hereinabove of use of the embodiment example, the width of the outer surface 59 is constituted smaller than the width of the strip material 12. An overflow of the fluid material at the side regions of the sheet 12 of material can be trapped by this itself, so that clean processing is made possible. The sheet-form material 12 applied to the foil 23 has, as a composite 24 in the end state, a sheet width which is smaller than the width of the outer surface 59, so that a composite 24 is created which has a bond completely over its width.

Figure 6:
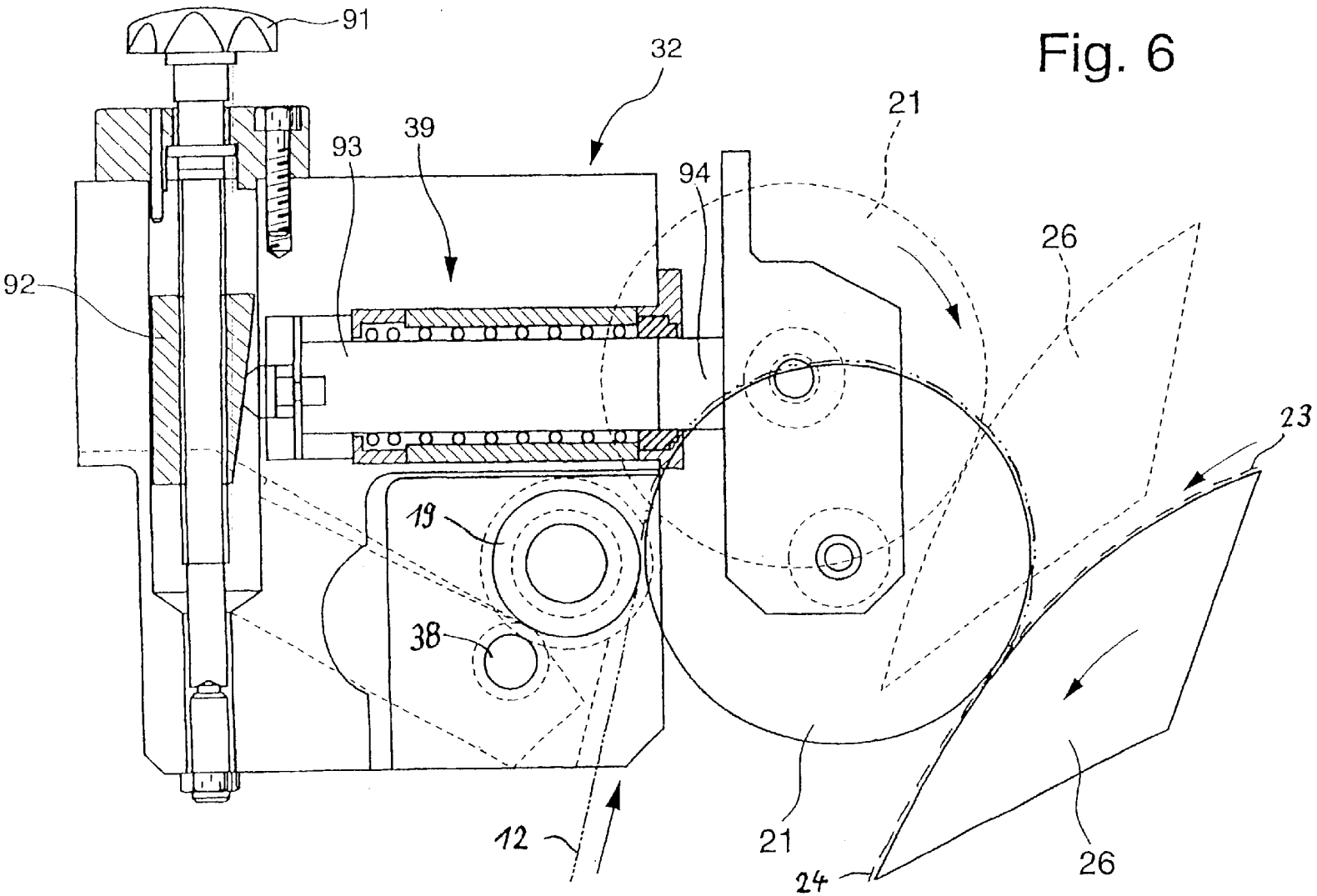
FIG. 6 shows an excerpt from a schematic enlarged side view of the apparatus according to FIG. 1 in an alternative mode of operation for the application of the fluid material to a surface of the sheet-form material.

FIG. 6 shows an adjusting mechanism by means of which the position of the transport roller 61 can be adjusted relative to the housing section 32. A wedge 92 is moved up and down in a slot by means of an adjusting screw 91, and is connected to a spring-loaded bolt 93. The bolt 93 can be inserted to a greater or lesser extent into the housing section 32 by changing the wedge position. The position of the transport roller 21 relative to the application roller 19 and to the roller 26 can thereby be adjusted, as is shown by dashed lines and as this reproduces the position according to FIGS. 1 and 2. With this arrangement, by means of the sheet tension, a more or less heavy abutment of the sheet-form material 12 on the application roller 19 is attained. A more or less strong sheet tension can be produced, in dependence on the strength of the sheet-form material 12. The application roller 19 has a speed of rotation which is equal to, or smaller than, the sheet speed of the sheet-form material 12. An application against the sheet tension can thereby take place, so that a so-called flying coating is achieved.

It can alternatively be provided that the transport roller 21 is arranged in a position which abuts on the application roller 19, as shown in FIG. 6. The pressing pressure of the roller 21 can by adjustable relative to the application roller 19 by means of the adjustment mechanism 39. The position of the transport roller 21 relative to the roller 26 can also be set at the same time. The adjustment mechanism 39 has a bearing element 94 by means of which the two above-described positions of the transport roller 21 can be set.

We claim:

1. Apparatus for the application of fluid material to a surface of a sheet-form material (12) with an application roller (19) which has a roller body (58) with an outer surface (59) which when at least partially abutting on the sheet-form material (12) transfers the fluid material to the sheet-form material (12) and with a metering doctor (36) to which a pre-metering channel (33) leads for provision of the fluid material and at least partially wets the application roller (19) with fluid material, wherein a flow of a medium directed substantially outward from a longitudinal mid-axis (55) of the application roller (19) is provided at least in a region bordering on the outer surface (59) of the application roller (19).

2. Apparatus according to claim 1, wherein at least one bore for supplying the medium and for further conducting it into the edge region of the outer surface (59) is provided at at least one end of a bearing region (48, 49) of the application roller (19).

3. Apparatus according to claim 1, wherein the roller body (58) has cross bores (82, 83, near end faces (61, 62) of the outer surface (59) of the application roller (19).

4. Apparatus according to one of the preceding claims, wherein a receiving member (51, 52) is provided at each end face (61, 62) of the roller body (58) and is constituted substantially complementary to the end (61, 62) of the roller body (58) and forms a gap (63) leading outward.

5. Apparatus according to claim 4, wherein the receiving member (51, 52) at least partially covers the cross bore (82, 83) and forms a channel as far as the gap (63).

6. Apparatus according to claim 4, wherein the receiving member (51, 52) is constituted as a bearing and has a bearing region (48, 49) for receiving the application roller (19).

7. Apparatus according to claim 1, wherein the end face (61, 62) of the roller body (58) is directed at right angles outward or at an angle from the longitudinal mid-axis (55) of the application roller (19) in the direction of the edge region of the sheet-form material (12).

8. Apparatus according to claim 1, wherein the gap formed between the end faces (61, 62) of the roller body (58) and the receiving member (51, 52) is adjustable.

9. Apparatus according to claim 1, wherein inserts can be installed on the end face (61, 62) of the application roller (19) and form a gap with the complementary receiving member (51, 52) and are interchangeable.

10. Apparatus according to claim 1, wherein interchangeable inserts for forming a gap (63) can be installed on the receiving member (51, 52).

11. Apparatus according to claim 1, wherein the application roller (19) has a right and left bearing region (48, 49), which are of crowned form.

12. Apparatus according to claim 1, wherein the application roller (19) is received by an adjustable bearing arrangement.

13. Apparatus according to claim 1, wherein a UV crosslinking-active adhesive is provided as the fluid material.

14. Apparatus according to claim 1, wherein a gaseous or liquid or gel-form medium, preferably compressed air, is provided as the fluid material for a leakproof or nearly sealing connection for the gap (63).

15. Apparatus according to claim 1, wherein the metering doctor (36) is constituted as a roller doctor which has metering pockets (40) extending at least over the length of the outside surface (59) of the roller body (58).

16. Apparatus according to claim 1, wherein the rotational speed of the application roller (19) is equal to or less than the sheet speed of the sheet-form material (12).

17. Apparatus according to claim 1, wherein the application roller (19) and the metering doctor (36) are provided in an application head (34) which has a pre-metering channel (33) which is constituted at least UV-protected.

18. Apparatus according to claim 1, wherein the fluid material constituted as a UV crosslinking-active adhesive can be supplied to the application roller (19) in a UV-protected dispenser (31) and preferably in a UV-protected housing section (32).

19. Apparatus according to claim 1, wherein the sheet material (12) abuts the application roller (19) under tension, which can be adjusted by means of a guide roller (18, 21), before and after the application roller (19) in the sheet forwarding direction.

20. Apparatus according to claim 1, wherein the transport roller (21) abuts on the application roller (19) with interposition of the sheet-form material (12).

21. Apparatus according to claim 1, wherein the length of the outside surface (59) of the application roller (19) is constituted shorter than the sheet width of the sheet-form material (12).

* * * * *